United States Patent [19]

Gray et al.

[11] Patent Number: 5,051,584

[45] Date of Patent: Sep. 24, 1991

[54] PLASMA MASS SPECTROMETER

[75] Inventors: Alan L. Gray, Farnham; Neil E. Sanderson, Sandiway; Neil Bradshaw, Heaton Mersey, all of United Kingdom

[73] Assignee: VG Instruments Group Limited, Haywards Heath, England

[21] Appl. No.: 543,750

[22] PCT Filed: Jan. 30, 1990

[86] PCT No.: PCT/GB90/00131

§ 371 Date: Jul. 20, 1990

§ 102(e) Date: Jul. 20, 1990

[87] PCT Pub. No.: WO90/09031

PCT Pub. Date: Aug. 9, 1990

[30] Foreign Application Priority Data

Jan. 30, 1989 [GB] United Kingdom ..... 8901975

[51] Int. Cl.[5] ..... H01J 49/04

[52] U.S. Cl. ..... 250/288; 250/281; 250/282

[58] Field of Search ..... 250/288, 281, 282

[56] References Cited

U.S. PATENT DOCUMENTS

| | | | |
|---|---|---|---|
| 3,616,596 | 11/1971 | Campargue | 250/288 |
| 4,121,099 | 10/1978 | French et al. | 250/281 |
| 4,358,302 | 11/1982 | Dahneke | 250/288 |
| 4,740,696 | 4/1988 | Osawa et al. | 250/288 |
| 4,760,253 | 7/1988 | Hutton | 250/288 |

FOREIGN PATENT DOCUMENTS

| | | |
|---|---|---|
| 199455A | 3/1986 | European Pat. Off. . |
| 6226757 | 4/1982 | Japan . |

OTHER PUBLICATIONS

Campargue, J. Phys. Chem., 1984, 88, pp. 4466–4474.
Beijerinck et al., Chem. Phys., 1985, 96, pp. 153–173.
Beauchemin. et al., Spectrochimica Acta, 1987, 42B, pp. 467–490.
Gregoire, Spectrochim Acta, 1987, 42B, pp. 895–907.
Kawaguchi et al., Anal. Sci., 1987, 3, pp. 305–308.
Gregoire, Appld Spectros., 1987, 41(5), pp. 897–903.
Longerich et al., Spectrochim Acta, 1987, 42B, pp. 101–109.
Hausler, Spectrochim Acta, 1987, 42B, pp. 63–73.
Houk et al., Anal. Chem., 1980 52, pp. 2283–2289.
PCT pub. No. 89/12313 (VG Instruments).
Randall et al., Rev. Sci. Instrum., 1981, 52 pp. 1283–1295.
Olivaries, PhD Thesis (part), Amer. Univ., 1985.
Gentry et al., Rev. Sci. Instrum., 1975, 46, p. 104.
Campargue et al., Proc. AIAA Conj. Ratefried Gas Dynamic, Jul. 1976, Snowmass at Aspen, USA, pub. 1977, pp. 1033–1045.

*Primary Examiner*—Jack I. Berman
*Assistant Examiner*—Kiet T. Nguyen
*Attorney, Agent, or Firm*—Chilton, Alix & Van Kirk

[57] ABSTRACT

The invention comprises a mass spectrometer wherein a sample is ionized in a plasma (14), especially an inductively-coupled or microwave-induced plasma. Ions are sampled from the plasma (14) through an orifice (16) in a sampling member (15), a second orifice (37) in a hollow tapered member (19) and a third orifice (53) in a tubular electrode (43). The hollow tapered member (19) comprises a portion (35) both externally and internally tapered with an interior included angle greater than 60°, and preferably a shorter externally tapered portion (38) with an external included angle of less than 60°. A tubular extraction electrode 43, preferably comprising a conical end-portion (47), is disposed within the member (19) for efficiently transmitting the ions into a mass analyzer.

19 Claims, 3 Drawing Sheets

TO PUMP
1
2
3
4
5
6
7
8
9
10
11
12
13
15
16
17
18
19
20
21
22
23
24
25
26
27
28
29
33
39

PLASMA MASS SPECTROMETER

This invention relates to a mass spectrometer in which a sample is ionized in a plasma, e.g. an inductively-coupled or microwave-induced plasma, in which ions characteristic of the elements comprised in the sample are formed.

Mass spectrometers having a plasma ion source comprising an inductively-coupled or microwave-induced plasma may be used for the determination of the elemental composition of a sample dissolved in a solution. Typically the solution is nebulized to produce an aerosol comprising droplets of the solution in an inert gas (e.g. argon) which is fed to a plasma torch. In the case of an inductively-coupled plasma, a coil of a few turns is disposed around the torch and fed with up to 2 kW of radio-frequency electricity (usually at 27 or 40 MHz), which generates a plasma in which ions characteristic of the elements comprised in the sample are formed. In the case of a microwave induced plasma, the end of the plasma torch is inserted through a cavity typically energized with up to 1 kW at 2.3 GHz, with a similar result.

In order to mass analyze the ions formed in the plasma, the torch is positioned so that the plasma is formed adjacent to a cooled sampling cone containing a hole in its apex, through which pass at least some of the ions to be analyzed, entrained in the plasma gas, into an evacuated region. A skimmer cone, also containing a hole in its apex, is disposed downstream of the sampling cone, with which it cooperates to form a molecular beam interface leading into a second evacuated region containing a mass analyzer, typically a quadrupole, and ion detector. In order to increase the efficiency of transport of ions through the region between the skimmer cone and the mass analyzer, an electrostatic lens system is conventionally provided to focus the ions emerging from the hole in the skimmer on the entrance aperture of the mass analyzer. Generally, a "photon-stop" is provided on the central axis of the lens system to prevent photons generated by the plasma from reaching the mass analyzer and increasing the noise level. Typically the lens system generally comprises a "Bessel-box" arrangement with the photon stop on the axis of the lens system in which the electrodes are biased so that at least some of the ions pass around the stop. Such a lens arrangement may also function as an energy analyzer. However, because the pressure immediately downstream of the hole in the skimmer is quite high, the motion of the ions in this region tends to be dominated by collisions with gas molecules rather than by the relatively weak electrostatic field present inside the skimmer, so that the transmission of ions to the analyzer is inefficient. Consequently in prior ICPMS systems the design of the sampling cone-skimmer interface has followed conventional molecular beam practice because the motion of the ions in this region is largely controlled by the flow of the very large excess of neutral molecules through the skimmer. The behaviour of these systems is well established and the parameters for optimum generation of a collimated beam are well established. See for example, Campargue, R, J. Phys. Chem, 1984, vol. 88 pp 4466–4474 and Beijerinck, HCW, Van Gerwen, RJF, et al, Chem. Phys, 1985, vol. 96 pp153–173. These theories predict that a skimmer comprising a cone of external and internal included angles of approximately 55° and 45°, respectively, provides optimum transfer efficiency and that any departure from these angles causes a marked reduction in efficiency.

Thus typically, in conventional ICP mass spectrometers the skimmer is positioned to sample from the "zone of silence" between the sampling cone and the estimated position of the Mach disk, and its external and internal included angles are typically 55° and 45° respectively. Similarly, the pressure in the region between the sampling cone and the skimmer is maintained in the region 0.1–2.0 torr, in the region where the "Campargue-type" skimmer theory would be expected to apply.

In prior ICP mass spectrometers, a variety of interferences are observed. In particular, there are matrix effects where the detection limit of a particular element may be worsened, often very significantly, by the presence of other elements or ions in the sample solution, even when there are no direct mass spectral overlaps. There appear to be many causes of these phenomena, see e.g., Beauchemin, McLaren and Berman, Spectrochim. Acta, 1987, vol 42B(3) pp 467–90, Gregoire, Spectrochim. Acta, 1987, vol 42B(7) pp 895–907, Kawaguchi, Tanaka, et al, Anal. Sciences, 1987, vol 3, pp 305–308 and Gillson, Douglas et al, Anal. Chem. 1988, vol 60 pp 1472–4. Gillson, Douglas, et al (ibid) suggest at least some of the interferences result from a defocusing of the ion beam as it passes through the skimmer cone as a result of the space charge developed by the beam. The defocusing clearly becomes worse when the beam current is increased (i.e., in the presence of larger concentrations of the interfering ions) and is likely to be mass dependent. In general, the experimental results obtained by many workers confirm that this effect is at least responsible for some of the troublesome suppression effects, bearing in mind that in practice it is often possible to alter the observed nature of the suppression by adjustment of the ion extraction lens potentials and other instrumental conditions. Gillson and Douglas (ibid) report an unsuccessful attempt to design an ion extraction lens system which would reduce this problem but do not describe the physical apparatus. However, Gregoire (Applied Spectrosc. 1987, vol 41(5) pp 897-) (esp p 897) and Longarch, Fryer and Strong, Spetrochim. Acta, 1987, vol. 42B pp 101–9 (esp p 109) describe modifications to ICPMS instruments which are believed by the present inventors to be similar to the system referred to by Gillson and Douglas. These workers report the use of a three-cylinder Einzel lens system between the skimmer cone and the Bessel-box lenses which appears to reduce the interference effects in comparison with the previous system used by these authors but does not significantly differ from the system used by other workers (e.g. Hausler, Spectrochim. Acta. 1987, vol 42B(½) pp 63–73). Unfortunately such systems still exhibit some suppression effects.

It is an object of the present invention to provide ICP and MIP mass spectrometers which exhibit a smaller degree of suppression by, and less interference from, matrix elements and/or ions than prior types. It is a further object to provide an ICP or MIP mass spectrometer having an interface between the plasma and the mass analyzer which has a higher efficiency than prior types. Further objects of the invention are the provision of ICP and MIP mass spectrometers with an improved sampling cone-skimmer interface and with an improved ion transmission system.

According to one aspect of the invention there is provided a mass spectrometer comprising a mass analyzer, means for generating a plasma in a flow of carrier gas, means for introducing a sample into said plasma, a sampling member adjacent said plasma comprising a first orifice through which at least some ions characteristic of said sample may pass into a first evacuated region, and a hollow tapered member disposed with its narrowest end closest to said sampling member and comprising in said narrowest end a second orifice through which at least some of said ions may pass from said first evacuated region to a second evacuated region and subsequently to said mass analyzer, said hollow tapered member comprising at least a portion both externally and internally tapered, with an interior included angle greater than 60°.

Preferably the interior angle is within the range 90° to 120°. Further preferably, the exteriors of the hollow tapered member and the sampling member are substantially conical and the members are disposed so that the first and second orifices lie on a common axis of symmetry.

Although the hollow tapered member may have a uniform taper and an included internal angle greater than 60°, in a preferred embodiment only a portion of the hollow tapered member adjacent to its broadest end has an interior included angle greater than 60°. The remaining part of the hollow tapered member, at its narrowest end, may comprise an externally tapered portion with an external included angle less than about 60°. In such a case the length of the portion having an included angle less than 60° will be substantially less than the length of the skimmer cone of uniform taper used in prior mass spectrometers to sample from the "zone of silence" between the sampling member and the Mach disk, as taught by Campargue. However, in a further preferred embodiment the length of the portion having an external included angle of less than 60° is selected so that the narrowest end of the hollow tapered member is upstream of the Mach disk. The distance between the first and second orifices may be selected to optimize the transmission of ions into the second evacuated region and the mass analyzer. It is found that this distance is quite critical, as it is in prior spectrometers, and is best determined by experiment. Preferably also, the pressure in the second evacuated region is maintained at less than $10^{-3}$ torr.

In a preferred embodiment only a portion of the hollow tapered member adjacent to its broadest end has an included angle greater than 60°, and the remaining portion in which the second orifice is formed has an included angle less than 60°, preferably between 40° and 50°.

In a further preferred embodiment, a tubular electrode may be disposed in the second evacuated region for transmitting ions emerging from the second orifice to the mass analyzer. The tubular electrode may comprise a substantially closed end portion with a third orifice therein, through which at least some ions may pass. Means are provided for maintaining a potential difference between the tubular electrode and the hollow tapered member. This potential difference may be selected not only to maximize transmission of ions to the mass analyzer but also to minimize matrix and interference effects, as discussed below. Preferably the third orifice is larger than the second orifice (in the hollow tapered member), and the sizes of both orifices may be selected to optimize transmission of ions and to minimize matrix effects, as above. Further preferably, the substantially closed end portion of the tubular electrode extends within the hollow tapered member, and this arrangement is facilitated by the relatively large internal angle of the broadest part of the hollow tapered member.

Conveniently, the tubular electrode and the hollow tapered member may have substantially circular cross sections and the substantially closed end portion may comprise a conical, part-spherical or frusto-conical member attached at its widest end to a substantially cylindrical portion of the tubular electrode. Typically, the third orifice is aligned with the second orifice on the axis of symmetry of the hollow tapered member.

In still further preferred embodiments mass spectrometers according to the invention are adapted for the determination of the elemental composition of a sample and comprise inductively-coupled plasma mass spectrometers (ICP) or microwave-induced plasma mass spectrometers (MIP). In such spectrometers a solution containing the sample elements may be introduced into the plasma in the form of an aerosol, usually in the carrier gas (argon or helium) in which the plasma is subsequently formed. The sampling member may conveniently comprise a hollow cone of greater internal included angle than the hollow tapered member, and the pressure in the first evacuated region may be maintained between 0.01 and 10 torr. Further preferably, the mass analyzer comprises a quadrupole mass analyzer disposed in the second evacuated region which is maintained at a pressure less than $10^{-3}$ torr. However, in high performance instruments, the quadrupole mass analyzer may be disposed in a third evacuated region, separated from the second region by a small orifice and maintained at a lower pressure than the second region. Alternatively, magnetic sector mass analyzers can be employed.

The inventors believe that the use of a hollow tapered member with an internal included angle greater than 60°, and an electrode comprising a substantially closed end portion allows a stronger and more efficient focusing of ions emerging from the second orifice to be achieved. This may reduce the mass-dependent loss of ions on the inside surfaces of the hollow tapered member which might otherwise occur as a result of the space-charge in the ion beam, and therefore may reduce the magnitude of the interference and matrix effects. Advantages are observed even when the external angle of the hollow tapered member is substantially greater than the generally accepted angle of about 55° at which the optimum molecular beam formation takes place, although the greatest advantage is obtained by using the two-portion member described above.

Viewed from another aspect the invention provides a method of determining the composition of a sample by mass spectrometry, said method comprising generating a plasma in a flow of gas, introducing a sample into said plasma, sampling ions present in said plasma through a first orifice in a sampling member into a first evacuated region, allowing at least some ions passing through said first orifice to pass through a second orifice in a hollow tapered member into a second evacuated region and transmitting at least some ions passing through said second orifice into a mass analyzer; said hollow tapered member comprising at least a portion both externally and internally tapered with an interior included angle greater than 60° and disposed with its narrowest end adjacent to said sampling member.

Preferably the hollow tapered member comprises at its broadest end the portion both externally and internally tapered and at its narrowest end an externally tapered second portion with an external included angle of less than about 60°.

Further preferably, a supersonic expanding jet of gas is formed in the first evacuated region between the first orifice and the hollow tapered member, and the length of the externally tapered second portion is selected so that the narrowest end of the hollow tapered member is located upstream of the Mach disk in the supersonic expanding jet. Means may be provided in the second evacuated region for generating an electrostatic field characterized by equipotential lines, a substantial proportion of which are within the hollow tapered member and cross its axis in substantially perpendicular directions. Preferably a major proportion of said equipotential lines are within said hollow tapered member, and in a most preferred embodiment, substantially all said equipotential lines are within said hollow tapered member. Conveniently, the means for generating the electrostatic field may comprise a tubular lens element with a substantially closed end portion disposed adjacent to the second orifice, and a third orifice in the closed end portion through which the ions pass.

In this way the trajectories of ions leaving the second orifice (in the hollow tapered member) can be confined to the vicinity of the axis in spite of the space charge associated with the ion beam, and loss of ions on the interior surface of the hollow tapered member can be minimized.

The invention extends to a hollow tapered member comprising an orifice in its narrowest end and having a portion both externally and internally tapered with an interior included angle greater than 60°, which is suitable for use as a skimmer cone in a sampling cone-skimmer interface between a plasma ion source and a mass analyzer. Preferably the hollow tapered member comprises at its broadest end the portion both externally and internally tapered and at its narrowest end an externally tapered second portion with an external included angle less than about 60°.

In all the above definitions the definition of the included angle relates to the included angle of the bulk of the appropriate portion of the member and not, for example, to the angle between tangents drawn immediately adjacent to the apex.

A preferred embodiment of the invention will now be described in greater detail by way of example and with reference to the following figures in which.

Figure 1:
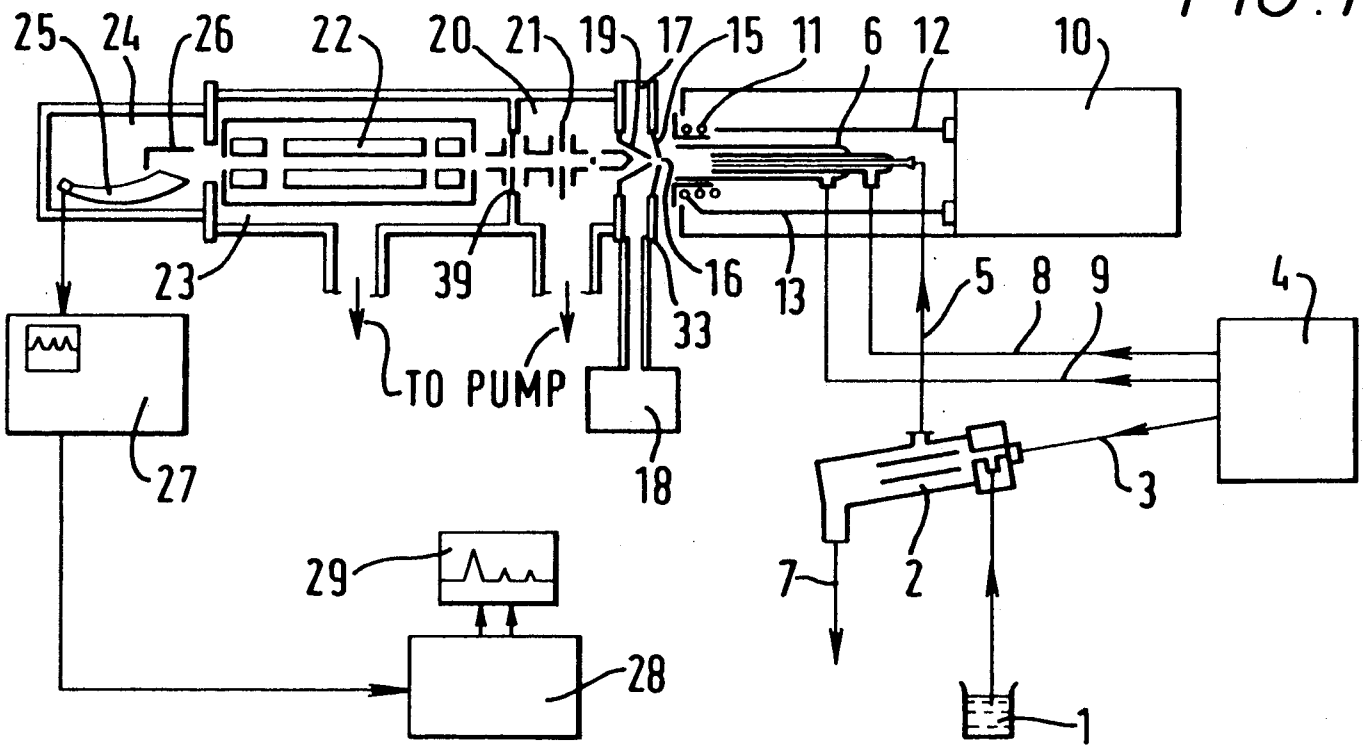
FIG. 1 is a schematic diagram of an ICP mass spectrometer according to the invention.

Referring to FIG. 1, a solution 1 of the sample to be analyzed is admitted to a pneumatic nebulizer 2 which is fed by a flow of argon gas in pipe 3 from a gas supply unit 4. The sample, entrained in argon gas, is introduced through a pipe 5 into a plasma 14 (FIG. 2) by means of a conventional ICP torch 6, and excess solution is drained from the nebulizer 2 through a drain 7. Gas supply unit 4 provides two other controlled flows of argon to torch 6 through pipes 8 and 9. A radio-frequency electrical generator 10 supplies energy to coil 11 via leads 12 and 13 so that the plasma 14 is formed at the end of torch 6.

ICP torch 6 and its associated equipment including gas supply unit 4, coil 11, generator 10 and nebulizer 2 are conventional items of equipment and need not be described further. Details of suitable equipment is given by Houk, Fassel. Flesch et al in Analytical Chemistry, 1980, vol 52, pp 2283–89. Although FIG. 1 illustrates the use of a pneumatic nebulizer for introducing a sample into the plasma 14, it is within the scope of the invention to use other methods, for example, electrothermal vaporization.

The plasma 14 is directed against a sampling member 15 mounted on a cooled flange 33 and containing a first orifice 16 which communicates with a first evacuated region 17. A vacuum pump 18 maintains the pressure in the first evacuated region 17 substantially below atmospheric pressure (typically between 0.01 and 10 torr). A skimmer comprising a hollow tapered member 19 separates the first evacuated region 17 from a second evacuated region 20 which is pumped by a diffusion pump (not shown), and a second orifice 37 (FIG. 3) is formed in the narrowest end of the hollow tapered member 19. An electrostatic lens assembly (schematically illustrated at 21) is disposed in the second evacuated region 20. A quadrupole mass analyzer 22 is disposed in another evacuated region 23, separated from the second evacuated region 20 by a diaphragm 39 containing another small orifice. In lower performance instruments the quadrupole analyzer 22 may be disposed in the second evacuated region so that the additional pump and diaphragm 39 may be dispensed with.

Ions which pass through mass analyzer 22 enter an ion detector 24 where they strike a converter electrode 26, releasing secondary electrons which enter an electron multiplier 25. The electrical signal generated by multiplier 25 is amplified by an amplifier in display unit 27 which in turn feeds a digital computer 28 and a terminal 29 to allow further processing of the data.

The quadrupole analyzer 22, detector 24 and the data acquisition system comprising items 27, 28 and 29 are conventional. The invention is not limited to the quadrupole mass analyzer shown in FIG. 1, however. Other types of mass analyzer may alternatively be used, for example a magnetic sector mass analyzer which may be interfaced as described in PCT publication number WO89/12313.

Figure 2:
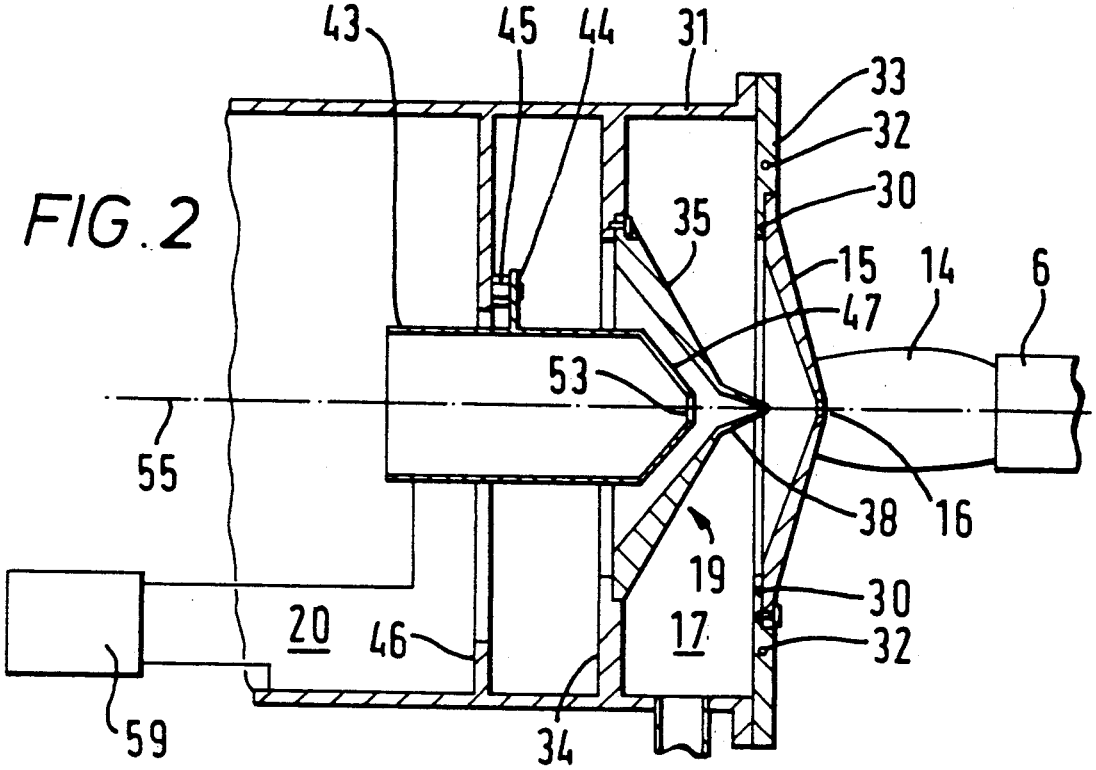
FIG. 2 is a drawing of a part of the spectrometer of FIG. 1.

Referring next to FIG. 2 which shows in more detail the components in the vicinity of the hollow tapered member 19, sampling member 15 comprises a hollow cone having a first orifice 16 in its apex and ar external angle of approximately 150°. It is bolted in good thermal contact with a flange 33 which comprises the end wall of a vacuum housing 31. A coolant, conveniently water, is circulated through passageways 32 in flange 33 to cool both it and the sampling member 15 which is in contact with the plasma 14. An 'O' ring 30 disposed in a circular groove in flange 33 provides a vacuum-tight seal between the sampling member 15 and the flange 33.

Sampling member 15 is conventional and may advantageously be polished in accordance with U.S. Pat. No. 4,760,253.

A diaphragm 34 is welded inside the vacuum housing 31 as shown in FIG. 2 and carries a hollow tapered member generally indicated by 19. Diaphragm 34 and member 19 comprise a substantially gas tight barrier which separates the first evacuated region 17 from the second evacuated region 20. Member 19 is mounted in a circular recess in diaphragm 34 but no additional sealing is required in view of the relatively low pressure in the first evacuated region 17.

Figure 3:
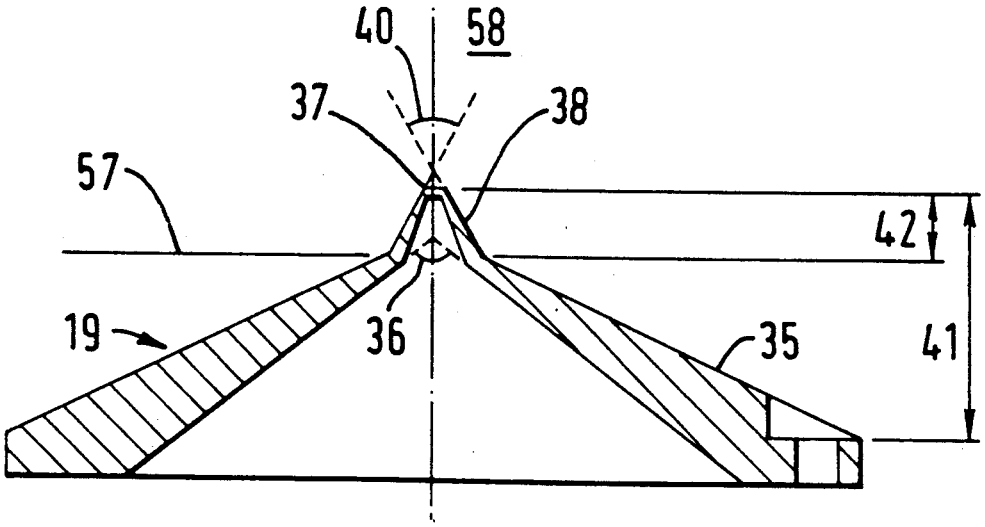
FIG. 3 is drawing of a hollow tapered member suitable for use in the invention.

The hollow tapered member 19, which is shown in greater detail in FIG. 3, is disposed with its narrowest end closest to the sampling member 15 and in the embodiment shown in FIG. 2 is substantially conical. It comprises a portion 35 both externally and internally tapered which has an interior included angle 36 of approximately 100°. In the preferred embodiment shown in FIGS. 2 and 3, member 19 further comprises a second externally tapered portion 38 which has an external included angle 40 of about 55°. The length 41 of the entire externally tapered portion of member 19 is 13 mm and the length 42 of the second portion 38 is 3.0 mm. The relatively short length 42 of the 55° included angle cone in comparision with the length 41 of the entire member allows a tubular electrode 43 (discussed below) to be brought close to the orifice 37, and is an important distinction over the 50° skimmer cones of the prior "Campargue" type skimmers used in prior ICP mass spectrometers, which are typically 12–15 mm long. Under the typical conditions employed in an ICP mass spectrometer, the inventors estimate that the Mach disk is situated along the plane 57 located approximately at the point where the external surface of the cone changes angle, so that the sampling of ions takes place upstream of the Mach disk from the "zone of silence" 58 which exists between it and the sampling member 15.

The distance between the first orifice 16 in the sampling member 15 and the second orifice 37 in the hollow tapered member 19 is quite critical, as it is in the case of a conventional ICP mass spectrometer. The correct distance is best found by experiment, determining the maximum ion beam intensity obtainable at each of a series of spacings, and selecting that spacing which results in maximum transmission efficiency.

Referring again to FIG. 2, a tubular electrode 43, which comprises a part of the lens assembly 21, is disposed in the second evacuated region 20 behind the hollow tapered member 19. It is supported by three lugs 44 disposed at 120° to each other which are welded to the outer part of the tubular electrode 43. Lugs 44 are attached to a mounting plate 46 welded into housing 31 by means of three insulated spacer and screw assemblies 45. The mounting plate 46 is out away to leave only sufficient material to support firmly each of the lugs 44 so that the evacuation rate of the region immediately inside member 19 is not significantly reduced by its presence. The tubular electrode 43 comprises a substantially closed end portion 47 consisting of a conical member attached at its widest end to a cylindrical portion. Member 47 extends within the hollow tapered member 19, as shown in FIG. 2. A third orifice 53 is formed in the end of the closed end portion 47 through which ions may pass after passing through the second orifice 37 in member 19. The diameter of the second orifice 37 is conveniently in the range 0.3–1.0 mm while that of orifice 53 is about 3.0 mm. The remaining electrodes comprising the electrostatic lens assembly 21 are similar to those employed in prior ICP mass spectrometers. Typically, lens assembly 21 may comprise two further cylindrical electrodes and a central photon stop. Means comprising an adjustable voltage power supply 59 are provided for maintaining a potential difference between the tubular electrode 43 and the hollow tapered member 19. The potentials on all the electrodes may be selected to optimize transmission of the ions to be analyzed from the second orifice 37 in the tapered member 19 to the mass analyzer 22, and to minimize matrix suppression effects. A centrally located photon stop is provided to minimize the number of photons and fast neutral particles which might otherwise pass from the plasma into the detector 24, causing an increase in noise. The lens assembly 21 is arranged so that the ion beam diverges around the photon stop, but some losses are inevitable, as in prior ICP mass spectrometers.

Figure 4A:
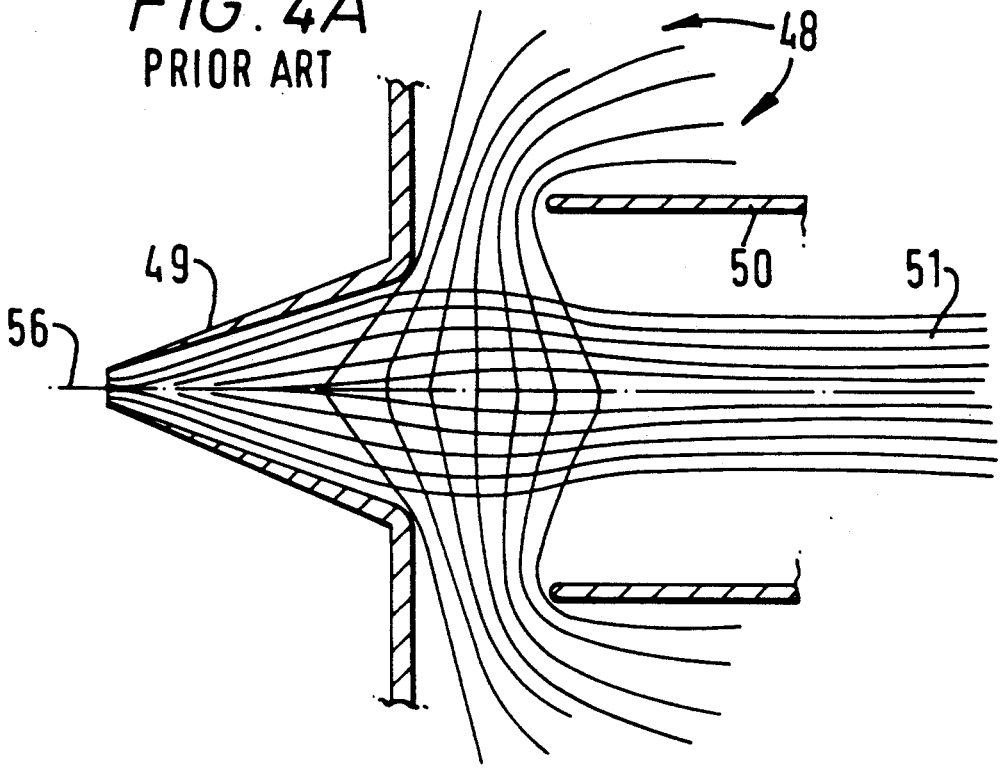
FIG. 4A PRIOR ART
FIGS. 4A and 4B respectively show calculated equipotential lines and ion trajectories in part of a prior spectrometer and part of a spectrometer according to the invention.

FIG. 4A shows a series of computer-predicted equipotential lines 48 which represent the electrostatic field which exists in the region behind the skimmer 49 and a cylindrical lens element 50 of a typical prior type of ICP mass spectrometer having a "Campargue" type skimmer of approximately 45° internal angle. It can be seen that there is very little penetration of the extraction field inside the skimmer 49. FIG. 4A also shows computer-predicted trajectories 51 of ions of mass 50 daltons and of initial energy 10 eV which pass through the orifice in the skimmer when the potential of the electrostatic lens element 50 is −200 volts with respect to the skimmer. The computer predictions of the trajectories take account of the space charge in the ion beam and those shown in the figure are the predicted trajectories for an ion current of 1 μA. These conditions are fairly typical of those which would be encountered in a prior ICPMS. Considerable expansion of the ion beam within the skimmer 49 is apparent, and more would be expected if the total ion beam current were greater than 1 μA and also if the trajectories 51 were calculated for lighter ions, e.g. 1 or 2 daltons instead of 50. It is clear from the predictions that there will be a significant and mass dependent loss of ions on the inside surface of the skimmer 49, confirming the similar results obtained by Gillson and Douglas (ibid).

Figure 4B:
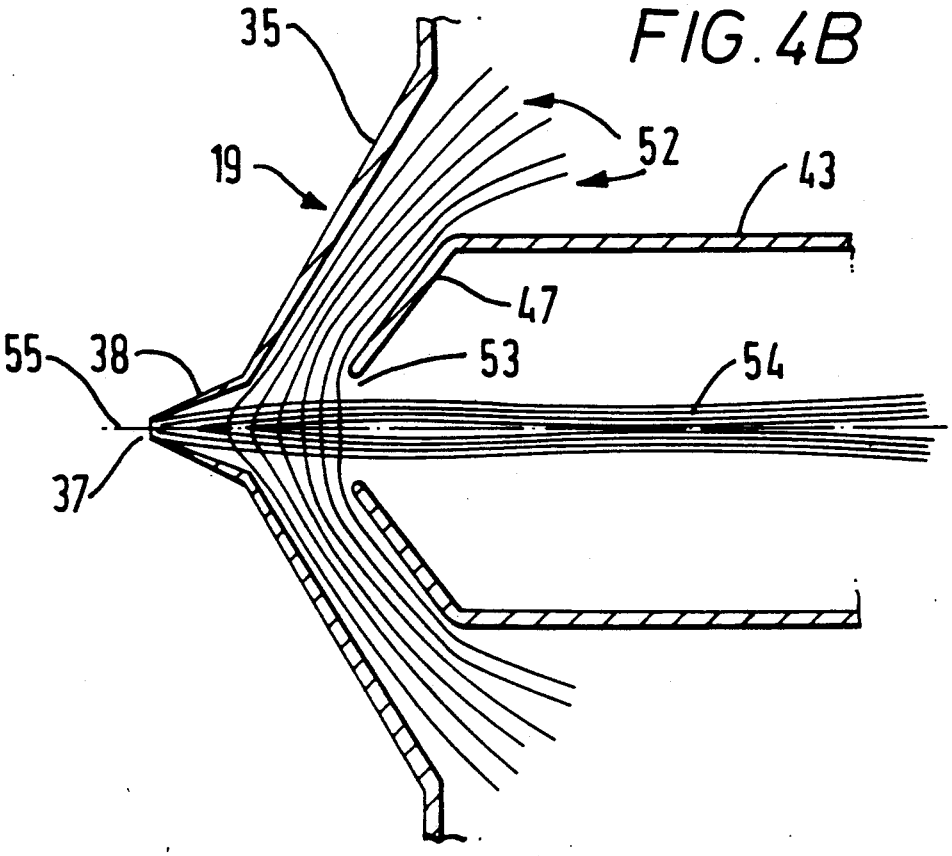

In contrast, FIG. 4B shows a series of equipotential lines 52 calculated for the electrostatic field which exists between the tubular electrode 43 comprising the closed end portion 47 and the inner surface of the hollow tapered member 19 in a mass spectrometer according to the invention. It will be seen that the equipotential lines 52 which characterize the electrostatic field are much closer to the orifice 37 and provide a stronger extraction field inside the skimmer than in the prior system of FIG. 4A. Further, more of the equipotential lines 52 are substantially perpendicular to the central axis 55 for a greater distance than in the case of the prior system FIG. 4A, which also improves the focusing. As a consequence, the computer-predicted trajectories 54 of ions passing through the orifice 37 in member 19, obtained for the same conditions used in the derivation of FIG. 4A, show much less expansion than trajectories 51. The inventors believe that this accounts for the improved transmission efficiency and reduced mass discrimination of a mass spectrometer constructed according to the invention. In the preferred embodiment a substantial proportion, and preferably all, of the equipotential lines are within the hollow tapered member 19.

We claim:

1. A mass spectrometer comprising a mass analyzer, means for generating a plasma in a flow of gas, means for introducing a sample into said plasma, a sampling member adjacent to said plasma comprising a first orifice through which at least some ions characteristic of said sample may pass into a first evacuated region, and a hollow tapered member disposed with its narrowest end closest to said sampling member and comprising in said narrowest end a second orifice through which at least some of said ions may pass from said first evacuated region to a second evacuated region and subsequently to said mass analyzer, said hollow tapered member comprising at least a portion both externally and internally tapered with an interior included angle greater than 60°.

2. A mass spectrometer according claim 1 wherein said included angle is in the range 90° to 120°.

3. A mass spectrometer according to either of claims 1 or 2 wherein the exteriors of said hollow tapered member and said sampling member are substantially conical and said members are disposed so that said first and second orifices lie on a common axis of symmetry.

4. A mass spectrometer according to any previous claim 1 wherein said hollow tapered member comprises at its broadest end said portion both externally and internally tapered and at its narrowest end an externally tapered second portion with an external included angle less than about 60°.

5. A mass spectrometer according to any previous claim 1 wherein said hollow tapered member comprises at its broadest end said portion both externally and internally tapered and at its narrowest end an internally tapered second portion with an internal included angle less than 60°.

6. A mass spectrometer according claim 1 wherein there is disposed in said second evacuated region a tubular electrode for transmitting ions emerging from said second orifice to said mass analyzer, said tubular electrode having a substantially closed end portion comprising a third orifice through which said ions may pass, and wherein means are provided for maintaining a potential difference between said tubular electrode and said hollow tapered member.

7. A mass spectrometer according to claim 6 wherein said substantially closed end portion extends within said hollow tapered member.

8. A mass spectrometer according to either of claims 6 or 7 wherein said tubular electrode and said hollow tapered member have substantially circular cross sections and said substantially closed end portion comprises a conical, frusto-conical or part-spherical member attached at its widest end to a substantially cylindrical portion of said tubular electrode.

9. A mass spectrometer according to any of claim 6 wherein said potential difference and the sizes of said second and third orifices are selected to minimize matrix suppression effects.

10. A mass spectrometer according claim 1 wherein said plasma is an inductively coupled plasma or a microwave induced plasma.

11. A skimmer cone suitable for use in a sampling cone-skimmer interface between a plasma ion source and a mass analyzer, said skimmer cone comprising a hollow tapered member with an orifice in its narrowest end and having a portion both externally and internally tapered with an interior included angle greater than 60°.

12. A hollow tapered member according to claim 6 comprising at its broadest end said portion both externally and internally tapered and at its narrowest end an externally tapered second portion with an external included angle less than about 60°.

13. A method of determining the composition of a sample by mass spectrometry, said method comprising generating a plasma in a flow of gas, introducing said sample into said plasma, sampling ions present in said plasma through a first orifice in a sampling member into a first evacuated region, allowing at least some ions passing through said first orifice to pass through a second orifice in a hollow tapered member into a second evacuated region, and transmitting at least some ions passing through said second orifice into a mass analyzer; said hollow tapered member comprising at least a portion both externally and internally tapered with an interior included angle greater than 60° and disposed with its narrowest end adjacent to said sampling member.

14. A method according to claim 13 wherein said hollow tapered member comprises at its broadest end said portion both externally and internally tapered and at its narrowest end an externally tapered second portion with an external included angle less than about 60°.

15. A method according to claim 14 wherein a supersonic expanding jet cf gas is formed in said first evacuated region between said first orifice and said hollow tapered member, and the length of said externally tapered second portion is selected sc that the narrowest end of said hollow tapered member is located upstream of the Mach disk in said supersonic expanding jet.

16. A method according to any of claims 13–15 wherein there is provided in said second evacuated region means for generating an electrostatic field characterized by equipotential lines, a substantial proportion of which are within said hollow tapered member and cross its axis in substantially perpendicular directions.

17. A method according to claim 16 wherein substantially all said equipotential lines are within said hollow tapered member.

18. A method according of claim 16 wherein said electrostatic field is generated by a tubular electrode comprising a substantially closed end portion extending within said hollow tapered member.

19. A method according claim 13 wherein said plasma is an inductively coupled or a microwave induced plasma.

* * * * *

UNITED STATES PATENT AND TRADEMARK OFFICE

CERTIFICATE OF CORRECTION

PATENT NO. : 5,051,584

DATED : 09/24/91

INVENTOR(S) : A. L. Gray, et al

It is certified that error appears in the above-identified patent and that said Letters Patent is hereby corrected as shown below:

Column 7, line 48, change "out" to -- cut --

Claim 2, line 1 (column 9, line 9), after "according" insert -- to --

Claim 4, line 1 (column 9, line 16), cancel "any previous".

Claim 5, line 1 (column 9, line 22), cancel "any previous".

Claim 6, line 1 (column 9, line 28), after "according" insert -- to --

Claim 9, line 1 (column 9, line 48), change "any of claim 6"
to -- claim 8 --

Claim 10, line 1 (column 9, line 52), after "according" insert -- to --

Claim 12, line 1 (column 10, line 7), change "6" to -- 11 --

Claim 18, line 1 (column 10, line 47), change "of" to -- to --

Claim 19, line 1 (column 10, line 51), after "according" insert -- to --

UNITED STATES PATENT AND TRADEMARK OFFICE

CERTIFICATE OF CORRECTION

PATENT NO. : 5,051,584

DATED : 09/24/91

INVENTOR(S) : A. L. Gray, et al

It is certified that error appears in the above-identified patent and that said Letters Patent is hereby corrected as shown below:

Add, after claim 19, the following additional claims:

Claim 20. A method according to claim 17 wherein said electrostatic field is generated by application of a potential to a tubular electrode comprising a substantially closed end portion extending within said hollowed tapered member.

Claim 21. A mass spectrometer according to either of claims 4 or 5 wherein there is disposed in said second evacuated region a tubular electrode for transmitting ions emerging from said second orifice to said mass analyzer, said tubular electrode having a substantially closed end portion comprising a third orifice through which said ions may pass, and wherein means are provided for maintaining a potential difference between said tubular electrode and said hollow tapered member.

Claim 22. A mass spectrometer according to either of claims 4 and 5 wherein there is disposed in said second evacuated region a tubular electrode for transmitting ions emerging from said It is certified that error appears in the above-identified patent and that said Letters Patent is hereby corrected as shown below:

second orifice to said mass analyzer, said tubular electrode having a substantially closed end portion comprising a third orifice through which said ions may pass, and wherein means are provided for maintaining a potential difference between said tubular electrode and said hollow tapered member and wherein said substantially closed end portion extends within said hollow tapered member.

Claim 23. A mass spectrometer according to either of claims 4 or 5 wherein said interior included angle of said portion of said hollow tapered member is in the range of 90° to 120°.

Claim 24. A mass spectrometer as claimed in either of claims 4 or 5 wherein there is disposed in said second evacuated region a tubular electrode for transmitting ions emerging from said second orifice to said mass analyzer, said tubular electrode having a substantially closed end portion comprising a third orifice through which said ions may pass, and wherein:

It is certified that error appears in the above-identified patent and that said Letters Patent is hereby corrected as shown below:

(a) means are provided for maintaining a potential difference between said electrode and said hollow tubular member;

(b) said tubular electrode and said hollow tapered member have substantially circular cross-sections; and (c) said substantially closed end-portion of said hollow tapered member comprises a conical, frusto-conical or part spherical member attached at its widest end to a substantially cylindrical portion of said tubular electrode.

Claim 25. A mass spectrometer as claimed in claim 4 wherein said plasma is an inductively-coupled plasma or a microwave-induced plasma.

Claim 26. A mass spectrometer as claimed in claim 5 wherein said plasma is an inductively-coupled plasma or a microwave-induced plasma.

UNITED STATES PATENT AND TRADEMARK OFFICE

CERTIFICATE OF CORRECTION

PATENT NO. : 5,051,584

DATED : 09/24/91

INVENTOR(S) : A. L. Gray, et al

It is certified that error appears in the above-identified patent and that said Letters Patent is hereby corrected as shown below:

Claim 27. A mass spectrometer as claimed in claim 25 wherein there is disposed in said second evacuated region a tubular electrode for transmitting ions emerging from said second orifice to said mass analyzer, said tubular electrode having a substantially closed end portion comprising a third orifice through which said ions may pass and wherein:

(a) means are provided for maintaining a potential difference between said electrode and said hollow tubular member;

(b) said tubular electrode and said hollow tapered member have substantially circular cross-sections; and (c) said substantially closed end-portion comprises a conical, frusto-conical or part spherical member attached at its widest end to a substantially cylindrical portion of said tubular electrode.

UNITED STATES PATENT AND TRADEMARK OFFICE

CERTIFICATE OF CORRECTION

PATENT NO. : 5,051,584

DATED : 09/24/91

INVENTOR(S) : A. L. Gray, et al

It is certified that error appears in the above-identified patent and that said Letters Patent is hereby corrected as shown below:

Claim 28. A mass spectrometer as claimed in claim 26 wherein there is disposed in said second evacuated region a tubular electrode for transmitting ions emerging from said second orifice to said mass analyzer, said tubular electrode having a substantially closed end portion comprising a third orifice through which said ions may pass and wherein:

(a) means are provided for maintaining a potential difference between said electrode and said hollow tubular member;

(b) said tubular electrode and said hollow tapered member have substantially circular cross-sections; and

UNITED STATES PATENT AND TRADEMARK OFFICE

CERTIFICATE OF CORRECTION

PATENT NO. : 5,051,584

DATED : 09/24/91

INVENTOR(S) : A. L. Gray, et al

It is certified that error appears in the above-identified patent and that said Letters Patent is hereby corrected as shown below:

(c) said substantially closed end-portion comprises a conical, frusto-conical or part spherical member attached at its widest end to a substantially cylindrical portion of said tubular electrode.

Signed and Sealed this

Twenty-third Day of June, 1992

*Attest:*

*Attesting Officer*

DOUGLAS B. COMER

*Acting Commissioner of Patents and Trademarks*